US007653962B2

(12) United States Patent
Gordon

(10) Patent No.: US 7,653,962 B2
(45) Date of Patent: Feb. 2, 2010

(54) RETRACTABLE HOSE FOR CENTRAL VACUUM CLEANING SYSTEM

(76) Inventor: Connie M Gordon, 16 Bart Dr., Canton, CT (US) 06019

( * ) Notice: Subject to any disclaimer, the term of this patent is extended or adjusted under 35 U.S.C. 154(b) by 736 days.

(21) Appl. No.: 11/290,915

(22) Filed: Nov. 30, 2005

(65) Prior Publication Data

US 2007/0119014 A1 May 31, 2007

(51) Int. Cl.
*A47L 5/38* (2006.01)

(52) U.S. Cl. ..... 15/314; 15/315

(58) Field of Classification Search ..... 15/314, 15/315; *A47L 5/38*
See application file for complete search history.

(56) References Cited

U.S. PATENT DOCUMENTS 2,396,059 A * 3/1946 Roberts ..... 138/122
6,120,615 A * 9/2000 Fletcher ..... 134/21
6,427,284 B1 * 8/2002 Harrelson et al. ..... 15/315
6,948,527 B2 * 9/2005 Ragner et al. ..... 138/119
2006/0070679 A1 * 4/2006 Ragner ..... 138/119

FOREIGN PATENT DOCUMENTS

DE 2608703 * 9/1977

* cited by examiner

*Primary Examiner*—David A Redding
(74) *Attorney, Agent, or Firm*—Law Office of J. D. Pemberton; John Pemberton

(57) ABSTRACT

The invention includes a central vacuum system for use in a dwelling. The system features a vacuum unit having an exhaust outlet and a vacuum inlet connected to a fixed gooseneck shaped tube, a flexible cloth hose having a first end and a second end, where the first end is operatively connected to the gooseneck shaped tube with clamping means and the second end contains means for connecting a vacuum attachment. The gooseneck tube contains a flange to engage the clamp attached to the hose so that the hose cannot be pulled from the vacuum system during use. The flexible hose is adapted to extend from the vacuum unit within the dwelling and out through a wall orifice provided to access a living space of the dwelling. The hose is manually collapsible over the tube by a user when the system is not in use.

20 Claims, 3 Drawing Sheets

RETRACTABLE HOSE FOR CENTRAL VACUUM CLEANING SYSTEM

BACKGROUND OF THE INVENTION

1. Technical Field

This invention relates generally to a retractable hose for a vacuum cleaning system and methods of use, and more particularly to a retractable hose for a home-based central vacuum cleaning system.

2. Description of Related Art

Central vacuum cleaning systems are well known and have been available for many years. Existing central vacuum systems consist of a central power unit typically located in the basement, pipe usually located in the walls, attic, and basement, inlet valves, and cleaning hose. The central power unit creates the vacuum. The pipe, typically 2 inch PVC pipe, is used to transfer the vacuum created by the power unit to an inlet valve. The inlet valve contains an attachment means whereby the cleaning hose can be attached. One inlet valve is usually installed every 600 square feet of space. The cleaning hose is often a long hose capable of reaching 600 square feet from the inlet valve.

In use the cleaning hose and other attachments such as cleaning brushes must be moved from one room to another when vacuuming a house. This is often quite cumbersome for the user and requires that the user have storage space for the lengthy hose and attachments. Some systems have built in mechanically controlled retractable hoses. However, such systems are often costly to install, maintain, and difficult as well as expensive to replace if broken.

While many central vacuum system designs include features that are useful to performing the task of removing debris during vacuuming, they do not typically provide a simple way to deploy a retractable hose that is also economically efficient.

Thus, a need exists for an apparatus and method of use for a retractable hose that addresses the aforementioned drawbacks.

SUMMARY OF THE INVENTION

One aspect the invention includes a central vacuum system for use in a dwelling. The vacuum unit has a central power unit and an inlet connected to a fixed gooseneck shaped tube. Connected to the gooseneck shaped tube is a flexible cloth hose having a first end and a second end, the first end operatively connected to the gooseneck shaped tube with clamping means such as a flexible rubber clamp. The second end contains a vacuum attachment end wherein various vacuum related cleaning tools can be attached such as a carpet brush, crevice brush, or upholstery brush. The flexible hose is adapted to extend from the inlet valve within a dwelling and out through a wall orifice to allow cleaning of an area. The hose is manually collapsible over the gooseneck tube by a user when the system is not in use and the gooseneck tube is configured so that the hose cannot be pulled off the gooseneck tube during use.

The hose is adapted to extend from the vacuum unit within the dwelling and out through a wall orifice by fixing a wall mount plate with a flip cover over the wall orifice. The gooseneck is configured with a flange at an end where the gooseneck tube meets the orifice, so that the hose cannot be pulled from the gooseneck tube during use. In one embodiment, the hose is made of flexible cloth such as canvas. In another embodiment, the canvas is lined with a flexible plastic material. In another embodiment, the clamping means comprises a flexible rubber clamp. The vacuum attachment may be covered with a soft flexible cloth.

As is known in the art, the vacuum system of the invention can be placed between an interior wall of the dwelling and an exterior wall of the dwelling prior to completion of construction of the walls of the dwelling. Alternately, the vacuum system of the invention can be placed outside the interior wall of the dwelling within the living space; wherein the system is enclosed by finish building materials, such as wood or plaster.

Another embodiment of the invention includes a replacement hose for use in the vacuum system of the invention. The hose comprises a coil surrounded by a flexible cloth and includes clamping means for affixing the hose over the gooseneck tube.

The cloth of the replacement hose comprises canvas wherein the canvas is lined with a flexible plastic material. The clamping means may comprise a rubber clamp.

Advantageously, the length of the hose may be selected to extend to a predetermined distance. In this way, the hose can be customized for a particular living space.

Alternately, the replacement hose can be manufactured to be available to users in preselected lengths. For example, the length of the hose may be selected so that the hose extends between 15 and 20 feet when in use.

During operation of the system, the hose is placed over the gooseneck tube and has the ability to glide easily up and down the gooseneck tube due to its flexible material composition. The flange on the end of the gooseneck tube keeps the hose from being pulled out of the wall during use. The flange end of the gooseneck tube is in contact with a wall mount plate on the exterior of the finished wall. The hose can be extended away from the gooseneck tube until the clamping means engages with the flange.

To use the vacuum system, a user opens the wall plate and manually pulls the canvas hose out to the desired length and attaches a cleaning attachment to the attachment end of the hose. After performing vacuuming, the user manually collapses the hose back into the wall. The hose slides down the gooseneck tube and easily compress onto the gooseneck tube. This allows the user to easily move from room to room to vacuum debris without having to transport a cumbersome length of hosing. The hose may be advantageously installed during construction of a new home prior to finishing an interior wall. A user may install multiple systems at multiple sites throughout a dwelling.

Advantageously, the user does not have to carry the hose from one room to another to accomplish vacuuming and the hose is easily stored in a retracted state inside the wall of the dwelling. Also, if the hose should become damaged and need to be replaced, the user can do so conveniently by temporarily removing the mounting plate, disengaging the clip that holds the hose over the pipe, inserting a new hose, reengaging the clip to fit over the new hose and replacing the mounting plate on the wall. Retractable hose attachments of the invention are more economical to use due to their composition of canvas.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 2:
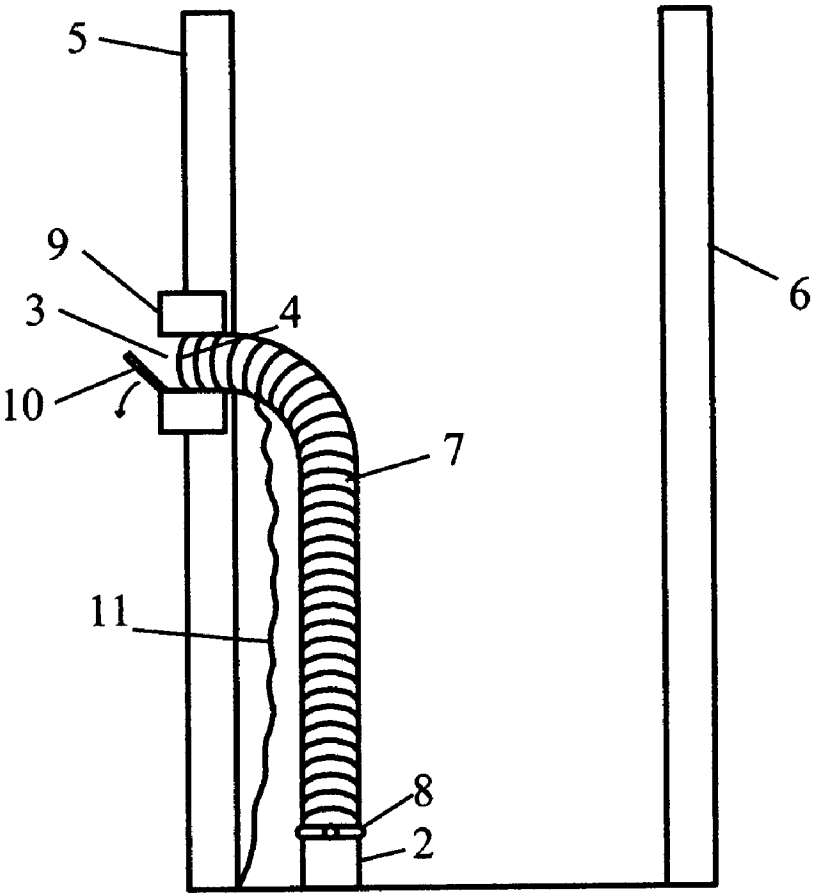
FIG. 2 is a side cross sectional view of a wall of a dwelling containing an embodiment of the invention when not in use.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Figure 1:
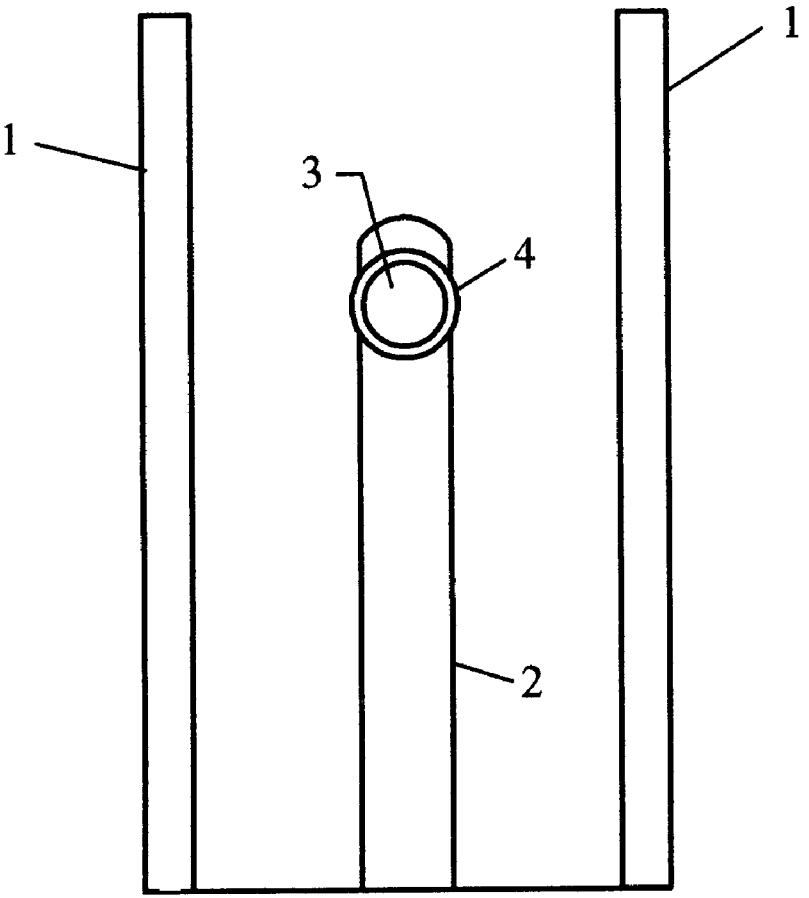
FIG. 1 is a front planar view of an embodiment of the invention in a dwelling house behind a wall.

The present invention includes a central vacuum system for use in a dwelling. Almost any known commercially available central vacuum system can be used in the present invention such as a traditional BEAM® central vacuum system attached to PVC piping as is known in the art. The central vacuum system contains a central power unit having an inlet connected to a fixed gooseneck tube 2 shown in FIG. 1.

Gooseneck tube 2 may be made of PVC or other suitable material and come in any diameter that is commercially available and used in construction of dwellings. For example, PVC pipe for use in embodiments of the invention may be between approximately 1 inch and approximately 4 inch PVC pipe. Gooseneck tube 2 is located between wall studs 1 and interior wall 5, FIG. 2, and exterior wall 6 of a living space of the dwelling. The distance between wall studs 1 can range between approximately 1.5 inches to approximately 4.5 inches for interior walls and between approximately 1.5 inches to approximately 6 inches for exterior walls. Gooseneck tube 2 extends from the inlet of the central power unit to wall orifice 3 which is located on interior wall 5 as shown in FIG. 2.

The side of gooseneck tube 2 that is proximate to wall orifice 3 is fitted with flange 4. Flange 4 is commercially available and of sufficient diameter to fit over gooseneck tube 2 and can be fixedly secured to gooseneck tube 2. Flange 4 creates a lip around gooseneck tube 2. Flange 4 is contact with wall orifice 3.

Figure 5:
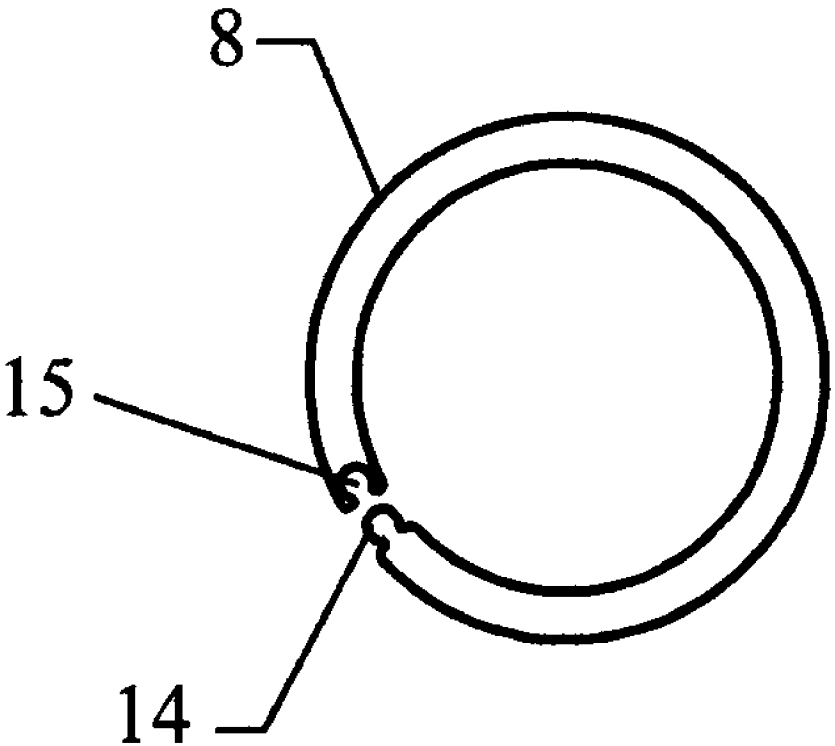
FIG. 5 is a planar view of a clip for attaching to an end of the hose of FIG. 4.
Figure 4:
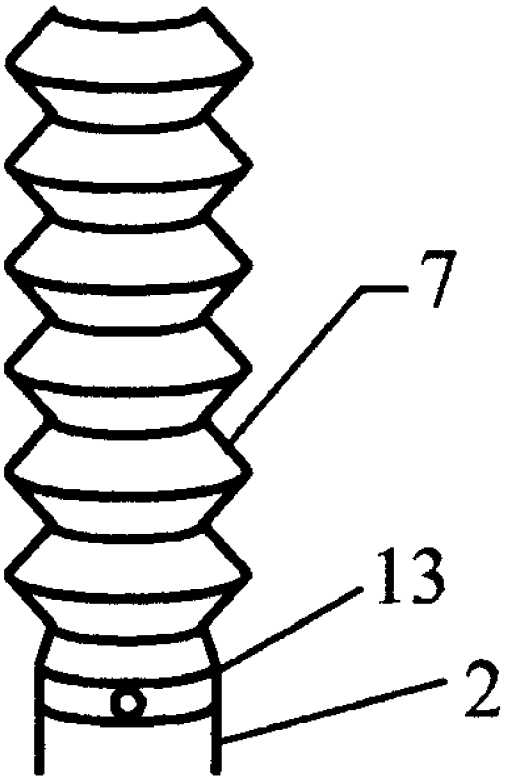
FIG. 4 is a planar view of a replacement hose for an embodiment of the invention.

As shown in FIG. 2, hose 7 surrounds at least a portion of gooseneck tube 2. Hose 7 has a first end and a second end wherein the first end contains clamp 8. Clamp 8 has a diameter greater than gooseneck tube 2 but smaller than flange 4 and can easily slide across the outer surface of gooseneck tube 2. Preferably, clamp 8 is a commercially available rubber clamps such as the one illustrated in FIG. 5. Clamp 8 contains end 14 that can variably fit into end 15 to adjust the interior diameter of clamp 8 to fit over gooseneck tube 2. In use, if a user pulls hose 7, FIG. 2, a predetermined distance away from wall orifice 3, clamp 8 will engage with flange 4 and prevent hose 7 from being pulled further from orifice 3. The predetermined distance is based on the desired length of hose 7 and may be custom designed to the particular living spaces of the dwelling or manufactured in custom predetermined lengths, such as about 15 to 20 feet when extended.

Hose 7 may be made of any kind of flexible cloth such as canvas or other flexible material that would slide easily over gooseneck tube 2 and is manually collapsible by a user over gooseneck tube 2 when the system is not in use. Preferably, hose 7 contains a semi rigid coil surrounded by the flexible material to add support for the flexible material. In addition hose 2 may be lined with a flexible plastic material (not shown) such that dust and debris could not escape through hose 7 during use.

Wall orifice 3 is surrounded by wall mount plate 9 within interior wall 5. Wall mount plate 9 is used to protect interior wall 5 when hose 7 is being pulled through wall orifice 3 and/or creates a relatively pleasing appearance for wall orifice 3. Wall mount plate 9 may be made of plastic, metal, or any other similar material that would protect interior wall 5 when hose 7 is being pulled through wall orifice 3 and/or creates a relatively pleasing appearance for orifice 3.

Flip cover 10 covers wall orifice 3 and is rotatively mounted to plate 9 with for example a hinge and can be extended away from interior wall 5 to enable the extraction of hose 7 from wall orifice 3. Electrical wire 11 is attached to an on/off switch and allows the central vacuum unit to be powered on or off. The on/off switch is located in a convenient location such as on wall plate 9 or on attachment end of hose 7. Attachment end of hose 7 contains means for attaching attachment 12, FIG. 3.

Figure 3:
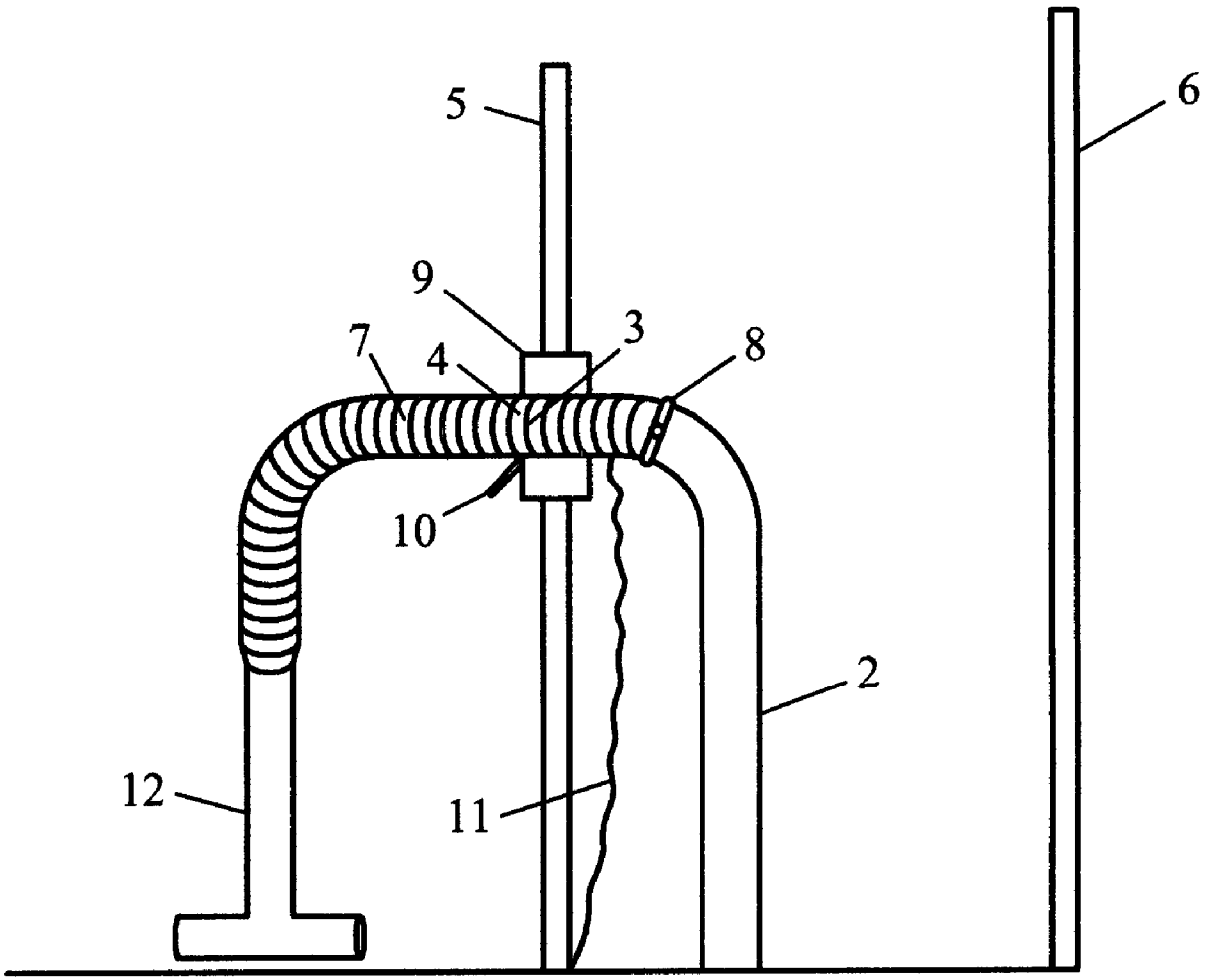
FIG. 3 is a side cross sectional view of a wall of a dwelling containing an embodiment of the invention when in use.

FIG. 3 depicts a cross sectional view of a wall of a dwelling during use of the present invention. Unlike FIG. 2 where hose 7 was in the storage configuration and not extended from wall orifice 3, in FIG. 3 hose 7 has been extended through orifice 3. During the extension of hose 7, clamp 8 slid up gooseneck tube 2 and hose 7 is prevented from being pulled out of wall orifice 3 when clamp 8 engages with flange 4. The attachment end of hose 7 has been fitted with vacuum attachment 12 for removing debris from the interior living space. Vacuum attachment 12 may almost be any vacuum related cleaning tool including but not limited to a carpet brush, crevice brush, or upholstery brush.

After use vacuum attachment 12 may be removed from hose 7 and hose 7 is manually collapsed back through wall orifice 3. The cloth material comprising hose 7 will enable it to slide easily over gooseneck tube 2 and into the storage configuration shown in FIG. 2. After hose is collapsed over gooseneck tube 2, cover 10 is then closed by the user. Advantageously, this allows the user to move from one living space to another without having to transport heavy or cumbersome tubing. It also allows convenient storage of hose 7, when not in use.

In one form, the assembly can be provided in a kit form which includes hose 7, clamp 8, and directions (not shown). If a hose becomes damaged during use, the user can easily temporarily remove wall mount plate 9, remove old hose 7 from gooseneck tube 2 by disengaging old clamp 8, place new hose 7 and new clamp 8 over gooseneck tube 2 and tighten new clamp 8 over new hose 7. After new hose 7 is slid over gooseneck tube 2 to where the attachment end engages with flange 4, the user can reinstall plate 8.

In another embodiment, wall plate 9 or cover 10 may include some means whereby one or more Vacuum attachments 12 may be stored.

The following illustrative example is intended to demonstrate certain aspects of the present invention. It is to be understood that this example should not be construed as limiting.

EXAMPLE

A central vacuum system of a dwelling was connected to embodiments of the invention in multiple living spaces within a dwelling. Prior to completion of construction of the dwelling, a 3-inch PVC gooseneck tube 2 was connected to a central vacuum exhaust system between the studs of walls within living spaces of the dwelling. One end of each gooseneck tube 2 was in contact with a corresponding wall orifice 3 in a corresponding interior wall 5 of the living space. Next each gooseneck tube 2 was fitted with flange 4. A flexible canvas hose 7 was fitted over gooseneck tube 2 and clamped on one end with a rubber clamp 8, such that the hose 7 could slide easily over the gooseneck tube 2 but was prevented from being extracted from wall orifice 3 due to clamp 8 coming into contact with flange 4.

Each wall orifices 3 was fitted with wall mount plates 9 to which flip covers 10 were then rotatively attached with a hinge. Hoses 7 were custom designed to various lengths for the particular living spaces of the dwelling. When not in use, hoses 7 were stored inside the wall between interior walls 5 and exterior walls 6.

For use in removing debris from a particular living space, a user opens wall orifice 3 by extending flip cover 10 away from interior wall 5 and manually extending hose 7 through orifice 3. The end of hose 7 that extends from wall orifice 3 is attached to vacuum attachment 12 and the debris is removed from the living space by the user. After removing debris, the user disengages vacuum attachment 12 and manually collapses hose 7 back into the wall of the living space. The user then proceeds to another living space within the dwelling requiring removal of debris and repeats the operation.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

What is claimed is:

1. A central vacuum system for use in a dwelling comprising:

a vacuum unit having an exhaust outlet and a vacuum inlet connected to a fixed gooseneck shaped tube;

a hose having a first end and a second end, the first end operatively connected to the gooseneck shaped tube with clamping means wherein the hose is adapted to extend from the vacuum unit within a dwelling and out through a wall orifice provided to allow access a living space of the dwelling; and a vacuum attachment on the second end of the hose wherein the hose is manually collapsible over said tube by a user when said system is not in use and said gooseneck tube is configured so that said hose can not be detached from said vacuum system during use.

2. The vacuum system of claim 1, where the hose is covered in a flexible cloth.

3. The vacuum system of claim 2, where the flexible cloth is canvas and the canvas is lined with a flexible plastic material.

4. The vacuum system of claim 1, where the clamping means comprises a flexible rubber clamp.

5. The vacuum system of claim 1, where the hose is adapted to extend from the vacuum unit within the dwelling and out through a wall orifice by fixing a wall mount plate with a flip cover over said orifice; and said tube is configured with a flange at an end where the tube meets the orifice, so that the hose cannot be detached from the vacuum system during use.

6. The vacuum system of claim 5, where the vacuum attachment is covered with a soft flexible cloth.

7. The vacuum system of claim 6, where the soft flexible cloth comprises canvas.

8. The vacuum system of claim 5, where the system is placed between an interior wall of the dwelling and an exterior wall of the dwelling prior to completion of construction of the walls of the dwelling.

9. The vacuum system of claim 5, where the system is placed outside the interior wall of the dwelling within the living space, wherein said system is enclosed by finish building materials.

10. The vacuum system of claim 1, where the hose is covered in a flexible cloth and the clamping means comprises a rubber clamp.

11. The vacuum system of claim 10, where the flexible cloth is lined with a flexible plastic material.

12. The vacuum system of claim 1, where the hose is a predetermined length and the predetermined length of the hose is selected such that the hose extends a predetermined distance in the living space.

13. The vacuum system of claim 12, where the predetermined length is customized for the living space.

14. The vacuum system of claim 12, where the length is selected so that the hose extends between about 15 and 20 feet when in use.

15. The vacuum system of claim 1, where the system is installed in multiple living spaces within the dwelling.

16. A method comprising:

extracting through a wall orifice, a hose having a first end and a second end, the first end operatively connected to a first end of gooseneck shaped tube wherein the gooseneck shaped tube has the first end and a second end, the second end of the gooseneck shaped tube operationally connected to a vacuum unit; and extending the second end of the hose away from the wall orifice wherein the second end of the hose contains a vacuum attachment.

17. The method of claim 16, further comprising manually collapsing the hose onto the gooseneck shaped tube such that the hose and the gooseneck shaped tube are concealed behind an interior wall of a dwelling.

18. A central vacuum system for use in a dwelling comprising:

a vacuum unit having a vacuum inlet connected to at least one fixed gooseneck shaped tube, wherein the at least one fixed gooseneck shaped tube is located within a dwelling;

at least one hose having a first end and a second end, the first end operatively connected to the at least one fixed gooseneck shaped tube wherein the at least one hose is adapted to extend from the at least one fixed gooseneck shaped tube and out through a wall orifice provided to allow access a space of the dwelling and the at least one hose is adapted is collapsible over the at least one fixed gooseneck shaped tube; and a vacuum attachment on the second end of the at least one hose.

19. The central vacuum system of claim 18, wherein the at least one fixed gooseneck shaped tube is located behind an interior wall such that the at least one hose and the at least one fixed gooseneck shaped tube are concealed when the at least one hose is collapsed over the at least one fixed gooseneck shaped tube.

20. The central vacuum system of claim 18, wherein the dwelling contains multiple living spaces and each living space contains at least one fixed gooseneck shaped tube and at least one hose.

* * * * *